US006354725B1

(12) United States Patent
Simon

(10) Patent No.: US 6,354,725 B1
(45) Date of Patent: Mar. 12, 2002

(54) BROAD ARCHITECTURAL ILLUMINATION FROM EXPANDED AND REMOTE LIGHT DISTRIBUTION OPTICS OF LUMINAIRES

(76) Inventor: Jerome H. Simon, 70 Sumner St., Newton Centre, MA (US) 02159

( * ) Notice: Subject to any disclaimer, the term of this patent is extended or adjusted under 35 U.S.C. 154(b) by 0 days.

(21) Appl. No.: 09/471,207

(22) Filed: Dec. 23, 1999

Related U.S. Application Data

(60) Provisional application No. 60/113,769, filed on Dec. 23, 1998.

(51) Int. Cl.[7] ..... E04D 13/00

(52) U.S. Cl. ..... 362/576; 362/147; 362/327; 362/404

(58) Field of Search ..... 362/326, 327, 362/147, 404, 811, 516

(56) References Cited

U.S. PATENT DOCUMENTS 3,705,303 A * 12/1972 Willis, Jr. et al. ..... 240/93

4,118,763 A * 10/1978 Osteen ..... 362/339

* cited by examiner

*Primary Examiner*—Sandra O'Shea
*Assistant Examiner*—John Anthony Ward
(74) *Attorney, Agent, or Firm*—Jerry Cohen; Harvey Kaye; Perkins, Smith & Cohen

(57) ABSTRACT

A light assembly includes a radial beam projector for being positioned in the vicinity of a ceiling of a room and spaced from at least some of the walls thereof. There may be at least two reflectors or refractors on or adjacent to the walls or ceiling of the room, each for receiving a separate light beam from the projector in at least two spaced locations and reflecting or refracting light into desired patterns to provide light for such room. The radial beam projector may project at least two light beams, one toward each reflector or refractor. There is also a light assembly which includes a circular reflector or refractor element on or adjacent to the walls or ceiling of such room for receiving a radial light beam from the projector and reflecting or refracting light into desired patterns to provide light for such room.

34 Claims, 15 Drawing Sheets

31
32
30
34
36
38
39

40
41
42
43

44
46
12
15
20
26
14
22
28
24
16
18
10

48

52
50

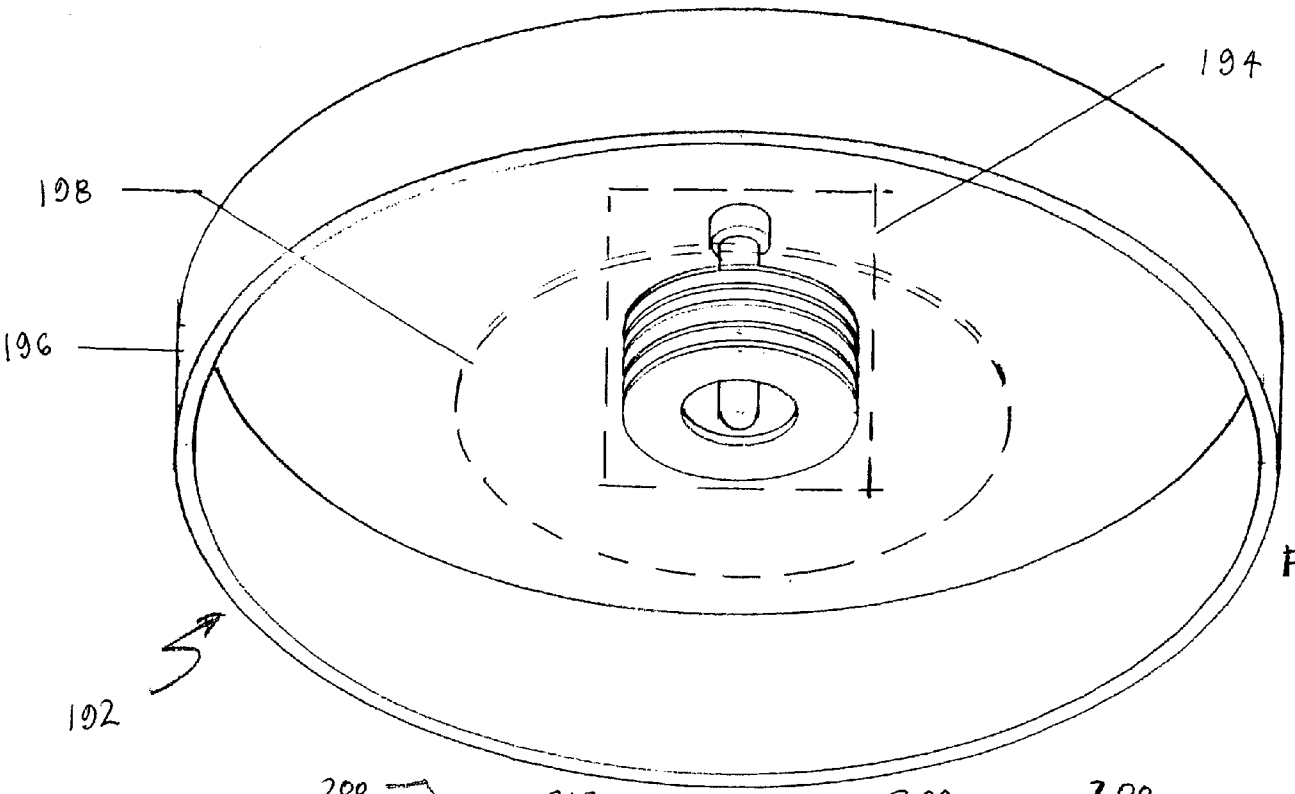
FIG. 17
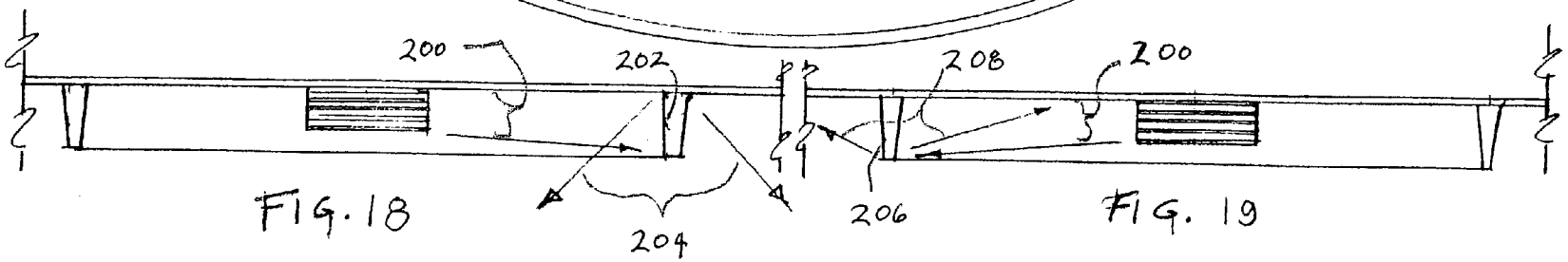
FIG. 18
FIG. 19

218
228
222
224
226
216
220
194
214
212
210

260
254
276
274

260
254
280
278

254

282
284
A1
270
A2
262
254
264
252
258
268
272
266
260
256
34

330
318
316

344
342
320
324
F2
330
340
328
336
338
F1
332
324

322
318
320
324
326
316

348
342
350
346

324
320

352

BROAD ARCHITECTURAL ILLUMINATION FROM EXPANDED AND REMOTE LIGHT DISTRIBUTION OPTICS OF LUMINAIRES

CROSS-REFERENCE TO RELATED APPLICATIONS

This application is based upon and claims the priority of Provisional Application Serial No. 60/113,769 filed Dec. 23, 1998.

FIELD OF THE INVENTION

The present invention relates generally to the lighting field, and, more particularly, to creating illumination that broadly distributes light using multiple beam and radial beam collimation.

SUMMARY OF THE INVENTION

It is an object of the present invention to provide a lighting system that broadly distributes illumination.

It is another object of the present invention to distribute illumination through the use of multiple beam and radial beam collimation (derived from quasi point source lamps).

It is a further object of the present invention to distribute illumination using the integrity of architectural structures for the optical alignment and structural support of the collimation devices, reflectors and refractors that are incorporated in the system.

It is a further object of the present invention to provide lighting which directly projects and distributes light broadly onto adjacent surfaces.

It is still a further object of the invention to use at least a portion of the architectural surfaces (walls and ceiling) as part of the luminaire reflecting surfaces.

It is still a further object of the present invention to provide a lighting system in which the architectural structure, (walls and ceiling) become part of the luminare alignment in that they hold the components (reflectors and refractors) in a location remote from the light source.

These and other objects of the present invention are accomplished in the following manners, among others.

A light assembly includes a radial beam projector for being positioned in the vicinity of a ceiling of a room and spaced from at least some of the walls thereof. There may be at least two reflectors or refractors on or adjacent to the walls or ceiling of the room, each for receiving a separate light beam from the projector in at least two spaced locations and reflecting or refracting light into desired patterns to provide light for such room. The radial beam projector may project at least two light beams, one toward each reflector or refractor. There is also a light assembly which includes a circular reflector or refractor element on or adjacent to the walls or ceiling of such room for receiving a radial light beam from the projector and reflecting or refracting light into desired patterns to provide light for such room.

The means by which the foregoing objects and features of invention are achieved are pointed out in the claims forming the concluding portion of the specification. The invention, both as to its organization and manner of operation, may be further understood by reference to the following description taken in connection with the following drawings.

BRIEF DESCRIPTION OF THE DRAWINGS

FIG. 17 is an isometric view of a radial beam projector surrounded by a remote refracting ring.

FIG. 18 is a schematic sectional view showing the radial beam striking the radial refracting ring.

FIG. 19 is a schematic sectional view showing the radial beam used for indirect lighting.

DETAILED DESCRIPTION OF THE PREFERRED EMBODIMENTS

Figures 1, 2, 3, 4, 5:
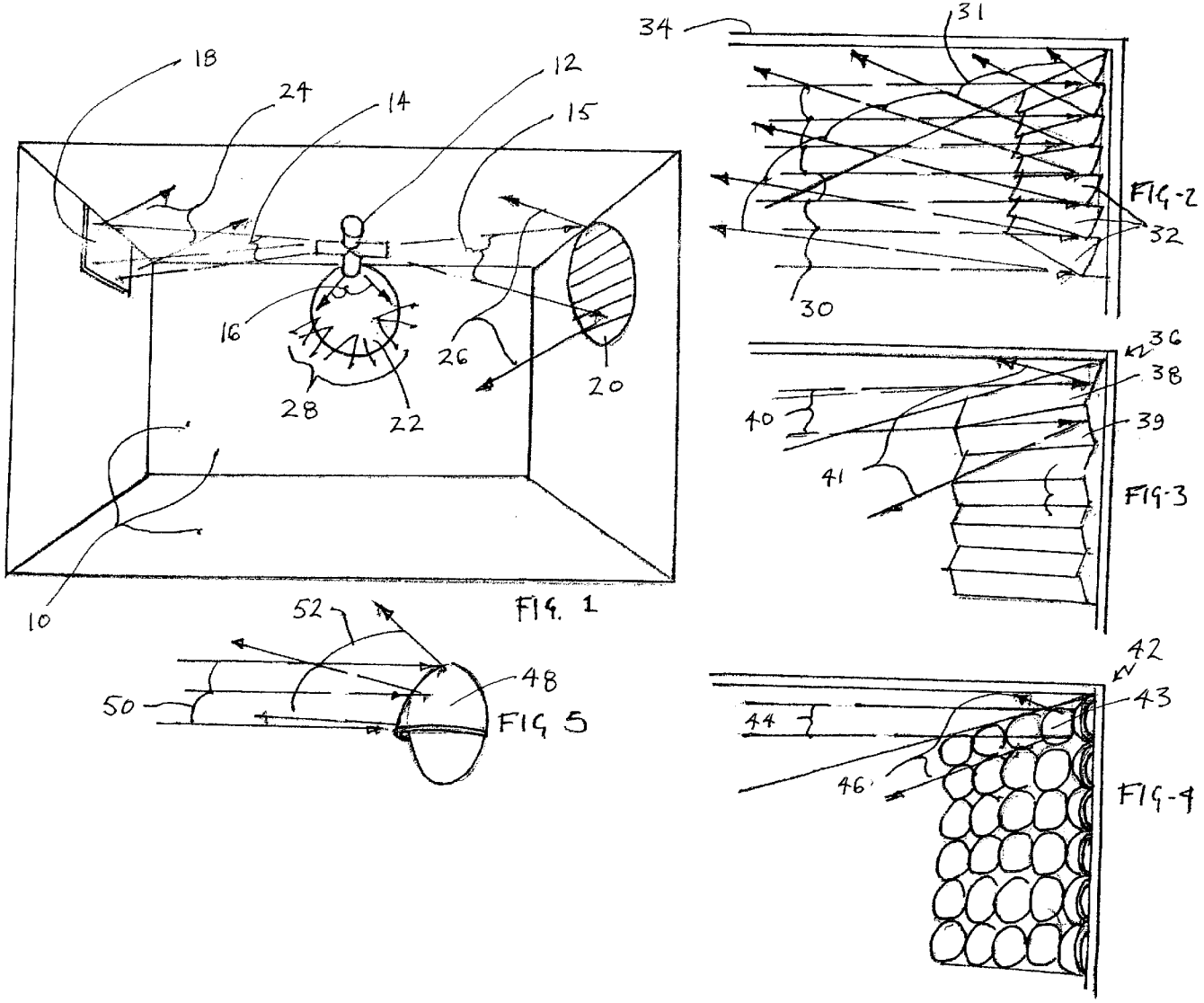
FIG. 1 is a schematic perspective view of a room having a multi-beam collimator mounted to the ceiling.
FIG. 2 is a partial view of one type of remote reflector which may be used with the arrangement shown in FIG. 1.
FIG. 3 is a partial view of another type of remote reflector which may be used with the arrangement shown in FIG. 1.
FIG. 4 is a partial view of a further type of remote reflector which may be used with the arrangement shown in FIG. 1.
FIG. 5 is a partial view of a single reflector which may be used alone or in a group of reflectors.

FIG. 1 illustrates a room 10 having a ceiling, floor, and walls on which a single lamp multi-beam collimator 12, mounted to the ceiling at a specific location, projects beams 14, 15 and 16 onto remote reflecting surfaces 18, 20 and 22, respectively. Each remote reflecting surface is mounted onto a wall of room 10 at a specific location in order to receive the beam projected by the multi-beam collimator. Each reflecting surface has a different reflecting quality as illustrated in reflected rays 24 which are reflected towards the ceiling from surface 18, reflected rays 26 which are reflected back towards the center of the room in a linearly divergent manner from surface 20, and rays 28 which are reflected in a scattered pattern from surface 22. Surface 22 may be the painted surface of the walls. If the reflector is the wall, the beam should have a defined shape, with a hard or soft edge, of substantially greater brightness on a defined area of the wall which is of substantially greater brightness than the surrounding area. In this case, the illuminated area from the light source beam on at least one architectural surface is thus a defined shape (with hard edges meaning sharply defined or soft edges meaning more gradually defined) of significantly greater brightness than the surrounding area.

Remote means that the reflectors and refractors are located so far from the light source that they cannot be or it is impractical to be supported on the same fixture as the light source.

FIGS. 2, 3 and 4 illustrate various types of remote reflectors. FIG. 2 shows projected rays 30 reflected by remote reflector sections 32, having a cross-section which is concave. Reflected rays 31 are reflected in a linearly divergent pattern upwardly to ceiling plane 34.

FIG. 3 shows remote reflector 36 having alternately disposed liner slats 38 and 39 dividing and reflecting projected rays 40 into upwardly reflected rays and downward reflected rays 41.

FIG. 4 shows remote reflector 42 having a pattern of specular convex shapes 43 reflecting received rays 44 into multiple divergent rays 46. The surface of reflector 42 may be of other grid type patterns of round concave, oval convex or concave, or other polygonal shapes.

FIG. 5 shows single reflector 48, which may be utilized alone or in a grid pattern, comprising a portion of a spherical convex surface that reflects received rays 50 into a section of divergent beam 52.

Figure 6:
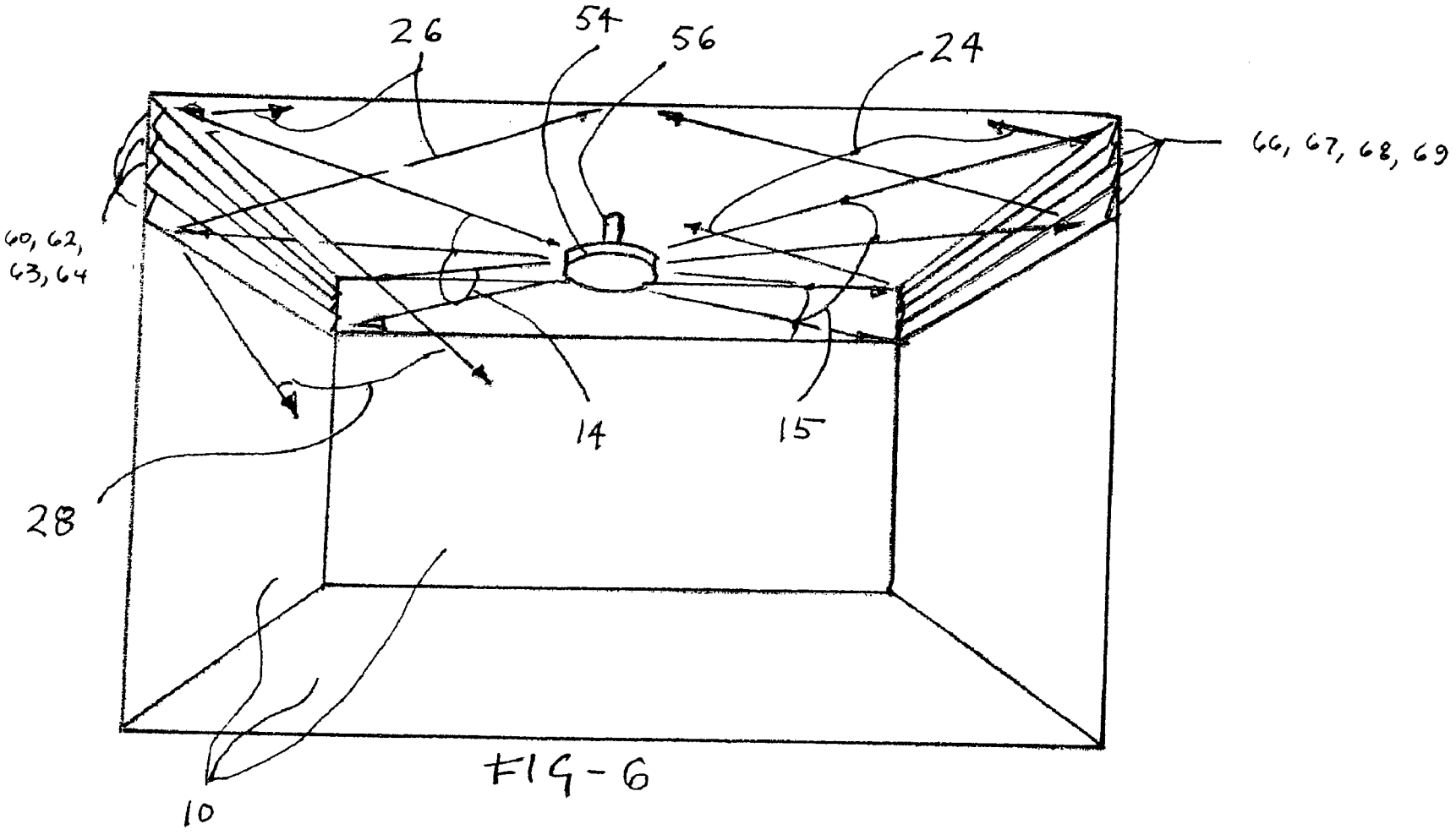
FIG. 6 is a schematic perspective view of a room using a radial beam projector.

FIG. 6 illustrates a variation of FIG. 1. Radial projector 12 of FIG. 1 is replaced with radial beam projector 54 which is attached to the ceiling of room 10 by electrical stem and attachment 56, 58. Beam projector 54 projects radial segments of radial beams 14 and 15 towards reflectors composite reflectors 60, 62, 63, 64 and 66, 67, 68, 69, respectively. Both composite reflectors 60, 62, 63, 64 and 66, 67, 68, 69 are mounted on the soffit areas of the walls of room 10. The illumination function of composite reflector 60, 62, 63, 64 is similar to that of reflector 36 of FIG. 3. The illumination function of composite reflector 66, 67, 68, 69 is similar to that of reflector 32 of FIG. 2.

FIGS. 7, 8, 9 and 10 illustrate a series of refracting elements designed to redistribute light beams projected from multi-beam, or radial projectors. Although these refracting elements are illustrated as being adjacent to ceiling plane 34, they may also be suspended from above, supported from below, or supported by the collimating device from which they are receiving light.

Figures 7, 8, 9, 10:
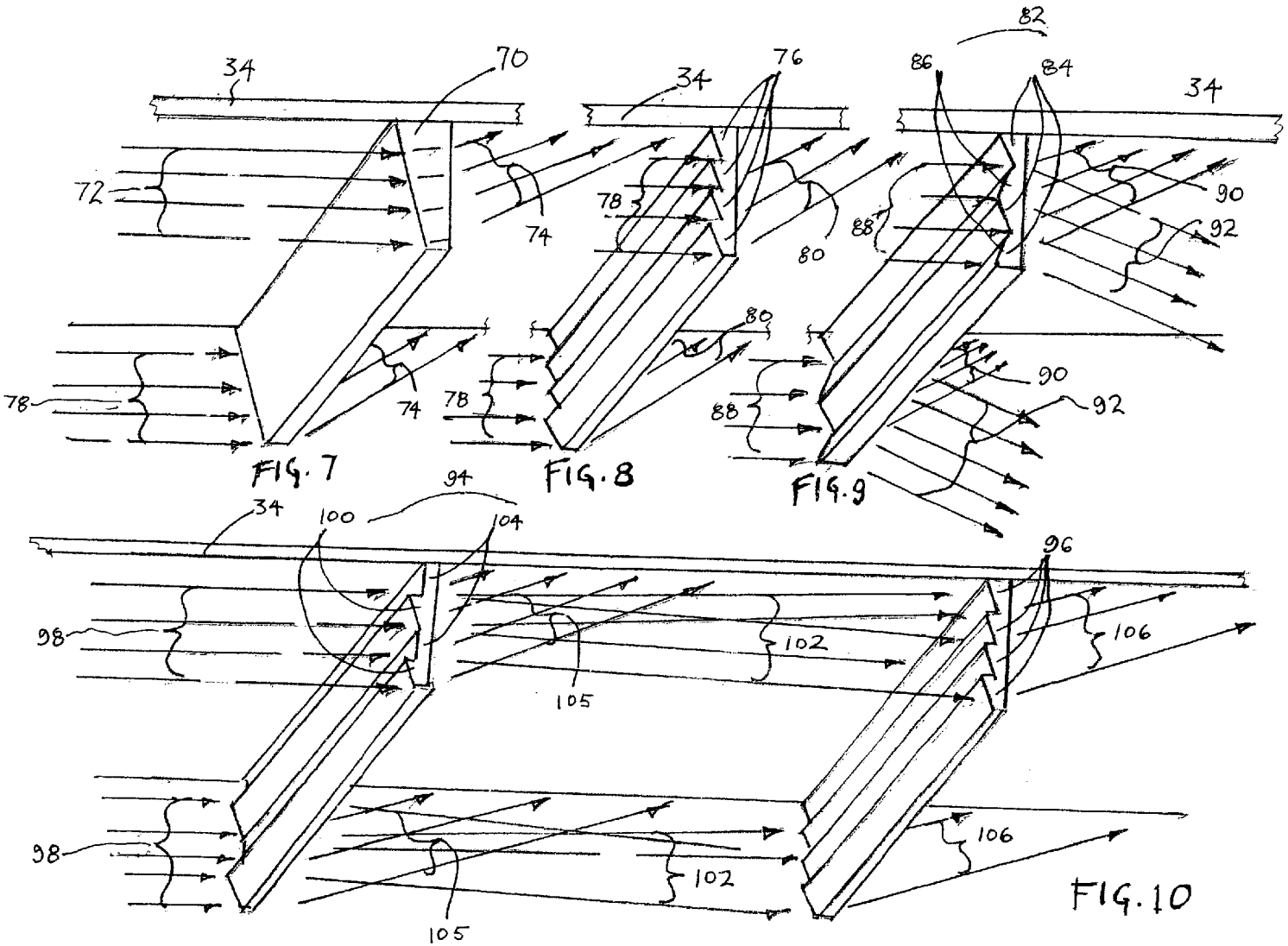
FIG. 7 is an isometric view of one type of refracting element which may be used with the arrangement shown in FIGS. 1 or 6.
FIG. 8 is an isometric view of another type of refracting element which may be used with the arrangement shown in FIGS. 1 or 6.
FIG. 9 is an isometric view of a further type of refracting element which may be used with the arrangement shown in FIGS. 1 or 6.
FIG. 10 is an isometric view of two sequential refracting element which may be used with the arrangement shown in FIGS. 1 or 6.

FIG. 7 shows an elongated wedge prism 70 receiving projected beams 72 and refracting them as rays 74 towards ceiling plane 34.

FIG. 8 illustrates an elongated segmented wedge prism 76 receiving projected rays 78 and refracting them as rays 80 towards ceiling 34.

FIG. 9 shows an elongated wedge prism 82 composed of wedge segments 84 and 86 splitting projected beams 88 into beams 90 (refracted towards ceiling 34) and beams 92 (refracted at an angle away from ceiling 34), respectively.

FIG. 10 shows two elongated refractors 94 and 96 which are designed to work in conjunction with each other. Projected beam 98 is refracted towards ceiling 34 as beams 105 by wedge prism sections 100 (of refractor 94) and transmitted (as beam 102) through window sections 104 (of refractor 94) to wedge refractor 96. Wedge refractor 96 refracts beam 102 towards ceiling 34 as beam 106. The wedge prism 96 may be substituted by the comparable structures shown in FIGS. 7, 8, or 9 or by reflectors 18 or 20 of FIG. 1, or reflector 32 of FIG. 2, or by reflector 36 of FIG. 3 or by reflector 42 of FIG. 4.

Although the planar shape of refractors 70, 76, 82, 94, and 96 is illustrated as rectangular, such shape may be round, oval, or any regular or irregular polygon; it may not be planar, but it may be circular, such as is shown in FIG. 17, or be convex or concave as part of a dome or the surface of a polyhedron.

Figure 11:
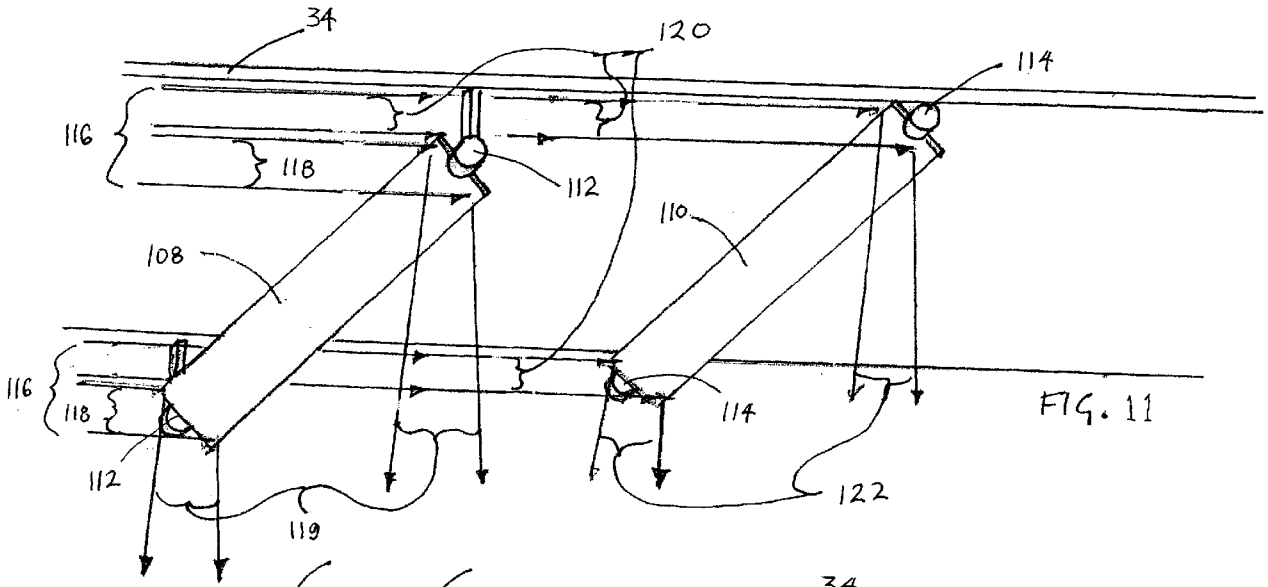
FIG. 11 is an isometric view of two sequential reflectors arranged on or near the ceiling.

FIG. 11 illustrates two sequential reflectors 108 and 110 mounted to (or suspended from) ceiling plane 34 on pivots 112 and 114 respectively. Reflector 108 is suspended from ceiling 34 at a predetermined distance therefrom leaving a space between reflector 108 and the ceiling. The reflector 108 is parallel to the ceiling and perpendicular to the beam 116. The projected beam 116 has an upper portion 120 and a lower portion 118. The lower portion 118 is reflected as reflected beam 119 and the upper portion 120 is allowed to pass over reflector 108 to reflector 110 which is mounted closer to ceiling plane 34. Upper beam portion 120 is reflected by reflector 110 as beam 122.

Figures 13, 14, 15:
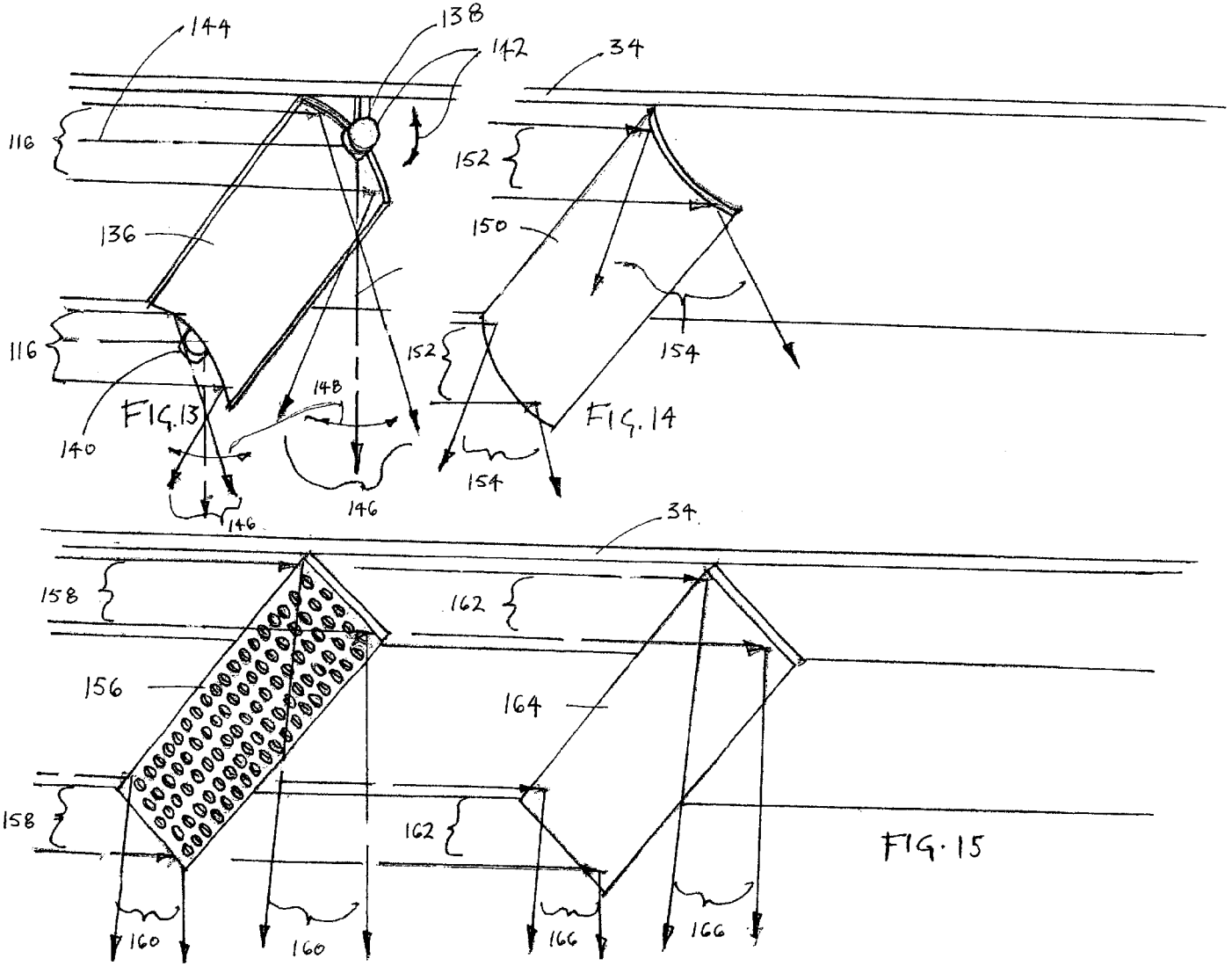
FIG. 13 is an isometric view of a convex linear reflector.
FIG. 14 is an isometric view of a convex linear reflector.
FIG. 15 is an isometric view of two sequential reflectors.

The movement of reflectors 108 and 110 is explained in FIG. 13. The surface shape and quality of reflectors 108 and 110 may be specular, textured, flat, concave, or convex.

Figure 12:
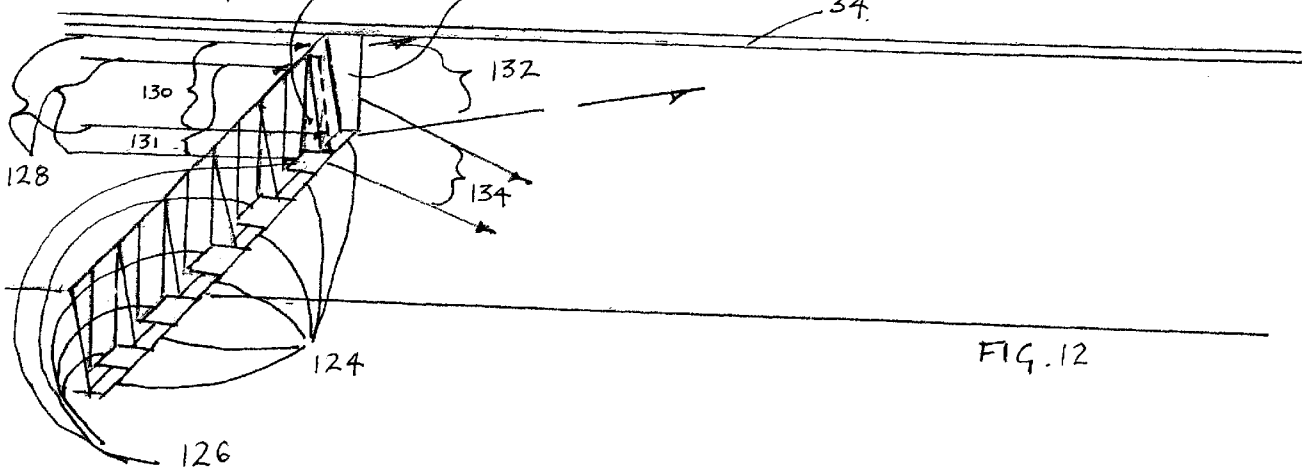
FIG. 12 is an isometric view of a rectangular prismatic refractor.

FIG. 12 illustrates a rectangular prismatic refractor comprised of alternate wedge prisms 124 and 126 which are horizontally oriented to receive beam portions 130 and 131, which form beam 128, and vertically oriented to refract beam portion 130 toward the ceiling 34 as beam 132 and beam portion 131 downward as beam 134. The sides of the prisms can be seen in this figure where the side 125 of prism 124 is shown as is the side 127 of prism 126. It will be seen that the side 125 of prism 124 widens as it tapers upwardly toward the ceiling and that the side 127 of prism 126 narrows as it tapers upwardly toward the ceiling.

FIG. 13 shows a convex linear reflector 136 mounted to the ceiling 34 on pivots 138 and 140. Movement of the reflector 136 is shown as graphic arrow symbol 142. Projected beam 116 having a beam axis 144 is reflected by linear convex reflector 136 as linear (converging then diverging) beam 146. The rotational movement of linear convex reflector 136 about pivots 138 and 140 results in a change of direction of reflected beam 146. This is illustrated by the movement of the reflected beam's axis represented by directional arrows 148.

FIG. 14 shows a fixed convex linear reflector 150 reflecting projected beam 152 as a linearly diverging beam 154. The surfaces of reflectors 136 and 150 may be convex or concave as shown or may be segmented into convex or concave portions.

FIG. 15 shows two sequential remote reflectors mounted to ceiling plane 34. The first reflector 156 is a perforated reflector (or a vacuum deposited beam-splitter) reflecting a portion of projected beam 158 as 160 and allowing the remaining portion to pass through as beam 162, which in turn is reflected by second reflector 164 as beam 166. The brightness ratio between reflected beams 160 and 166 is primarily determined by the ratio of reflectance to transmission of reflector 156.

Figure 16:
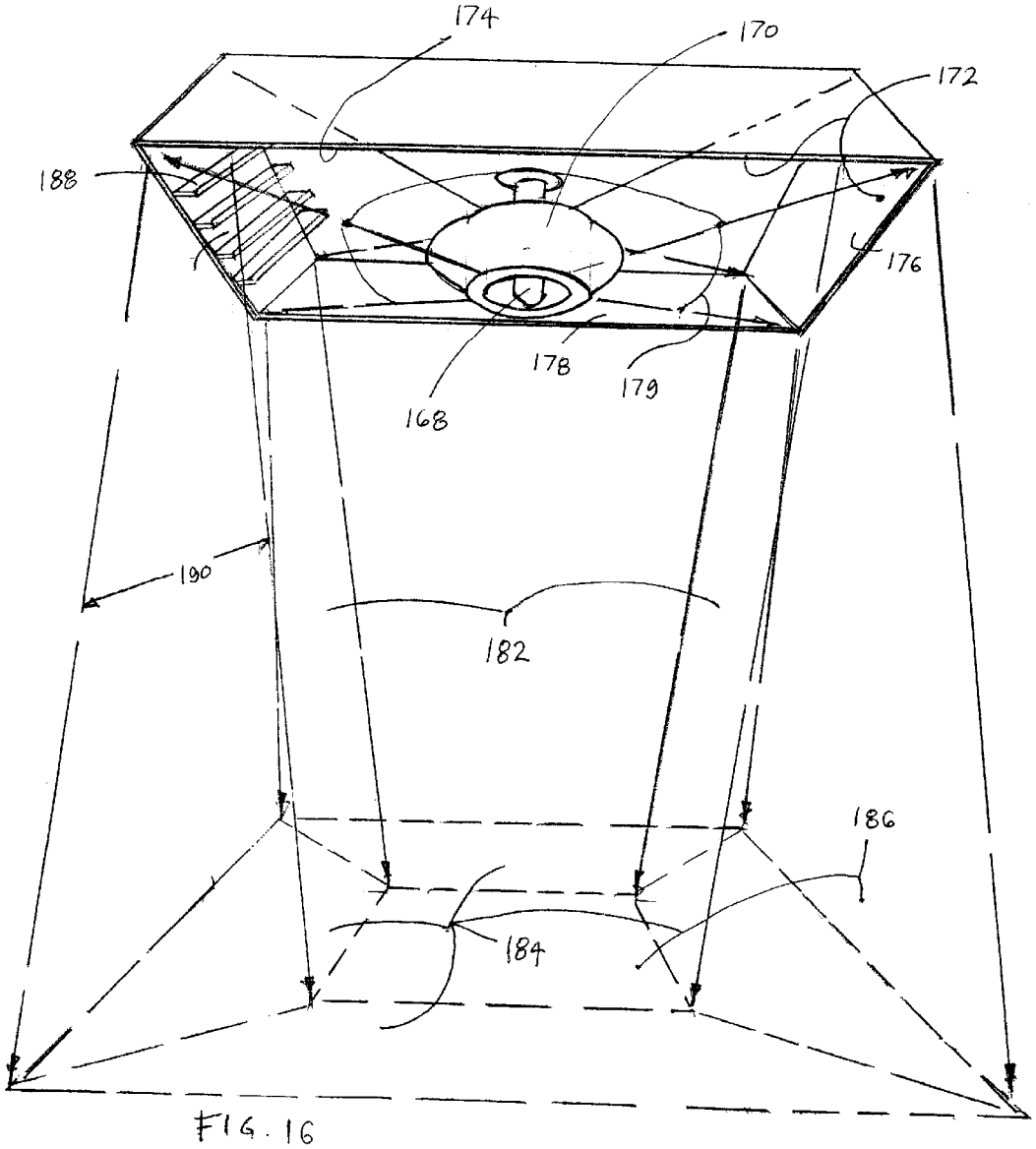
FIG. 16 is an isometric view of a radial collimator and a remote reflector surrounding it.

FIG. 16 illustrates light distributed by a light source such as a lamp 168 located within a radial collimator 170, together forming radial beam projector 179, and surrounded by remote reflector 172 that is rectangular in plan and comprised of linear reflecting surfaces 174, 176, 178 and 180. Light from lamp 168 is radially collimated by ring lens 170, and projected towards reflector segments 174, 176, 178 and 180, and reflected as projected beam pattern 182, resulting in illuminated beam pattern 184 of floor plane 186. The rectangular dimensions of pattern 184 are a direct result of the rectangular dimensions of remote reflector 172 as well as the cross-sectional curvature of surfaces 174, 176, 178 and 180 (which is described in the text of the description of FIGS. 13 and 14). Baffle fins 188 are optional and are used to control glare and to control linear dispersion 190 of beams 182.

FIGS. 17, 18, and 19 illustrate a light distribution assembly 192 comprised of a radial beam projector 194 surrounded by a refracting ring 196. FIG. 17 shows the addition of radial containment disk 198. Radial containment disk 198, an optional component, may be constructed of a reflective material or a refractive material having the function of total internal reflection in order to limit the vertical divergence of the radial beam 200. (Radial beam 200 is shown in FIG. 18.) This vertical limiting would be required if the divergence of beam 200 were such that a portion of beam 200 would not strike radial refracting ring 196. The containment of radially collimated light is discussed in U.S. Pat. No. 5,897,201 and in pending application PCT/US98/18419.

FIG. 18 illustrates radial beam 200 striking radial refracting ring 202. The structure of radial refracting ring 202 is such that radial beam 200 is refracted into a radially distributed downlight the cross-section of which is shown as rays 204.

FIG. 19 illustrates radial beam 200 striking radial refracting ring 206. The structure of radial refracting ring 206 is such that beam 200 is refracted into a radially distributed indirect pattern the cross-section of which is shown as rays 208. Cross-sections and functions of refracting ring 196 are illustrated in, but not limited to, FIGS. 7, 8, 9 and 12 and FIGS. 7, 8, 9, 10 and 12 show refracting using a rectangular shape.

Figures 20, 21, 22:
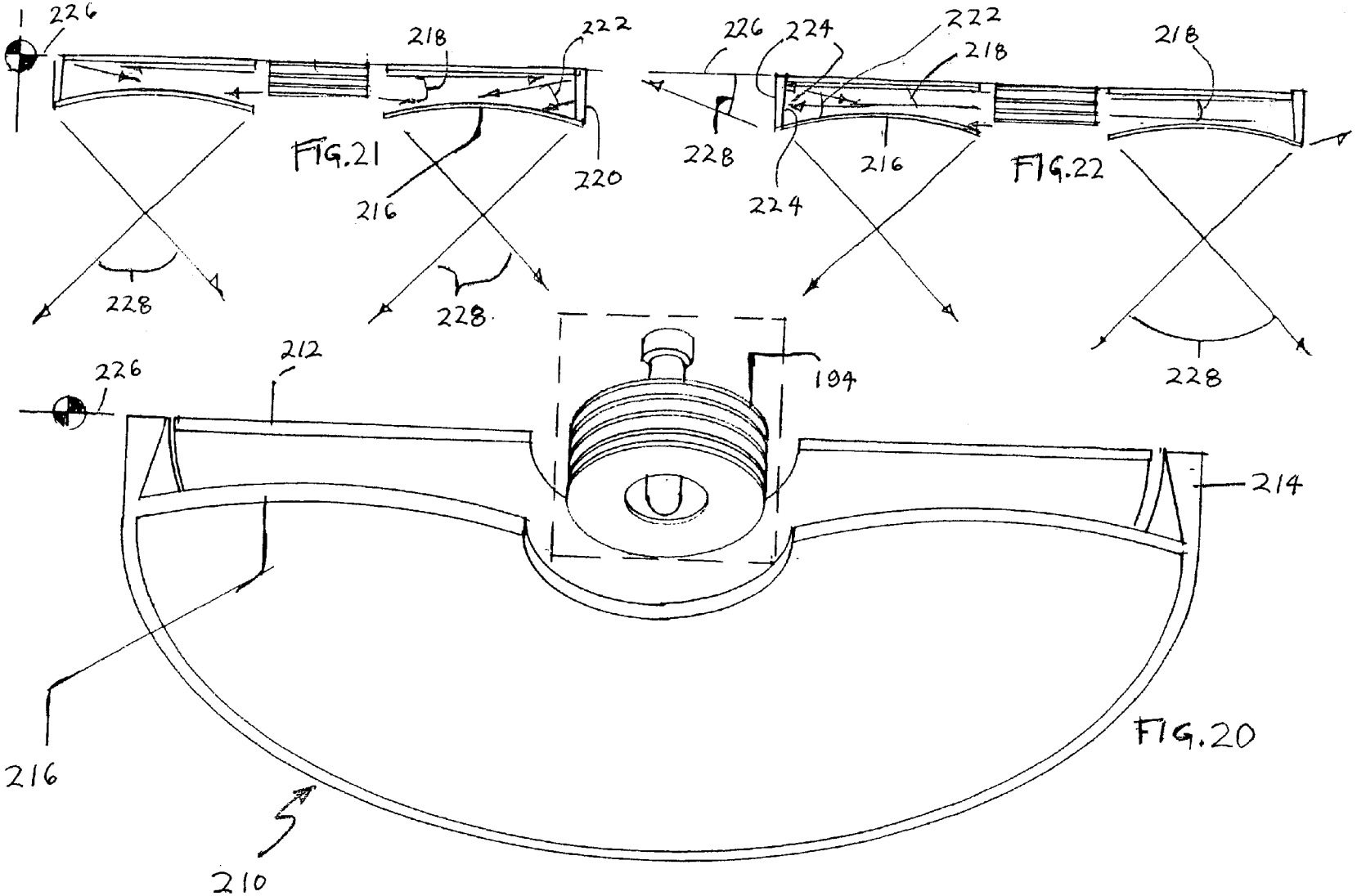
FIG. 20 is an isometric view of a radial beam projector in the center of a disk shaped light distribution structure.
FIG. 21 is a schematic sectional view of a detail of the arrangement shown in FIG. 20.
FIG. 22 is a schematic sectional view of a detail of the arrangement shown in FIG. 20 and having a dual function.

FIGS. 20, 21 and 22 illustrate various aspects of a light distribution system. FIG. 20 shows a radial beam projector 194 located in the radial center of disk shaped light distribution structure 210 which is comprised of the following elements: a radial containment disk 212 (the function of which is explained in the description of FIG. 17), a radial refracting ring 214 (whose various functions will be described below) and a radial wave disk 216 (which is further described). Radial containment disk 212 may be replaced by the plane to which light distribution structure 210 is mounted if the plane (ceiling or wall) is a partially or fully reflective surface.

FIG. 21 is a sectional diagram of FIG. 20 showing radial beam 218 projected radially outward and intercepted by the curvature of radial wave disk 216. Rays of beam 218 not intercepted by disk 216 strike radial ring 220. In this instance ring 220 is reflective, and reflects beam 218 as rays 222 back towards wave disk 216. Wave disk 216 is a wave guide refractor, the structure and function of which is disclosed in pending U.S. patent application Ser. No.: 09/451,068, filed Nov. 30, 1999, as a continuation of International Application No. PCT/US 98/11382 having an international filing date of Jun. 3$^{rd}$, 1998, and entitled Reflective and Refractive Wave Lens for Light Shaping.

FIG. 22 shows refractive ring 224 having the dual function of refracting a portion of rays from radial beam 218 toward the ceiling plane 226 as rays 228 and reflecting a portion of rays from 218 back toward 216.

Although light distribution assembly 192 of FIGS. 18 and 19 are shown adjacent to a ceiling plane and light distribution structure 210 in FIGS. 20, 21 and 22 are shown adjacent to ceiling plane 226, both light distributors 192 and 210 may also be suspended from a ceiling plane.

Figure 23:
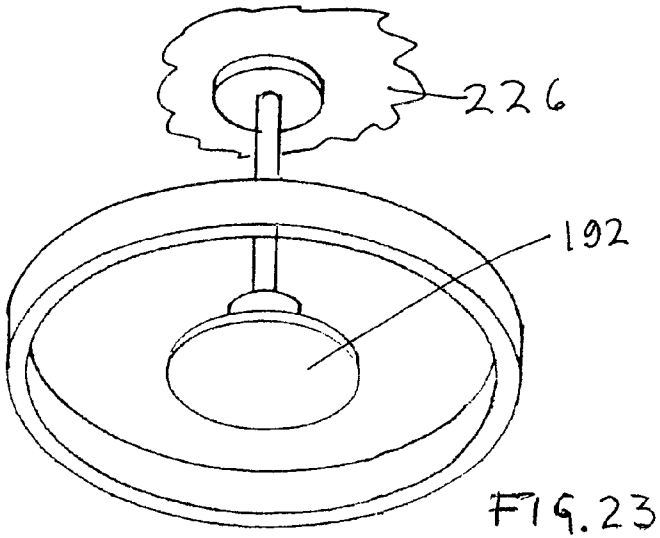
FIG. 23 is an isometric view showing a suspended version of the fixture shown in FIGS. 17, 18 and 19.

FIG. 23 is a suspended version of FIGS. 17, 18 and 19.

Figure 24:
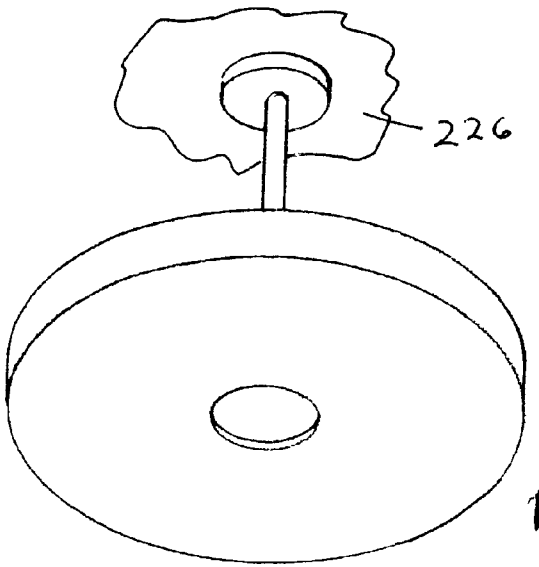
FIG. 24 is an isometric view showing a suspended version of the fixture shown in FIGS. 20, 21 and 22.

FIG. 24 is a suspended version of FIGS. 20, 21 and 22.

Figure 25:
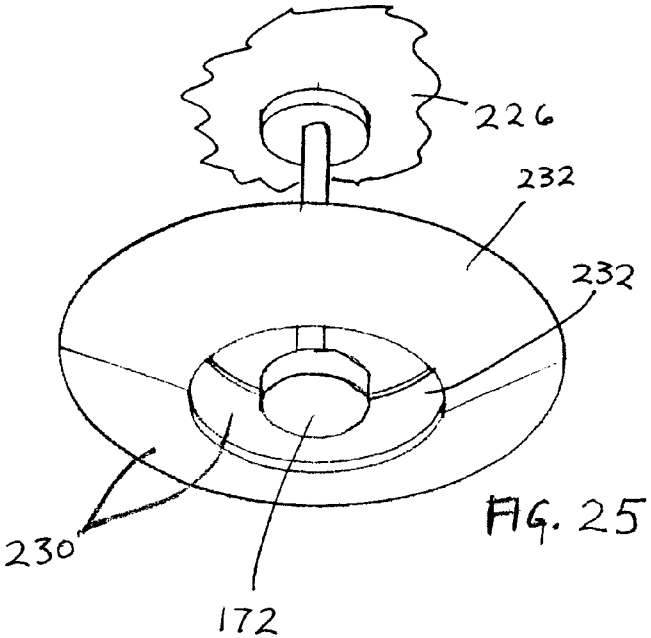
FIG. 25 is an isometric view showing a suspended arrangement having a refraction ring in the form of two flat truncated cones.

FIG. 25 illustrates a pendant (suspended) ring fixture having a refraction ring 230 in the form of two flat truncated cones 232. In this case refraction ring 230 may be prismatically refractive or comprised of sections of stained glass.

Figure 26:
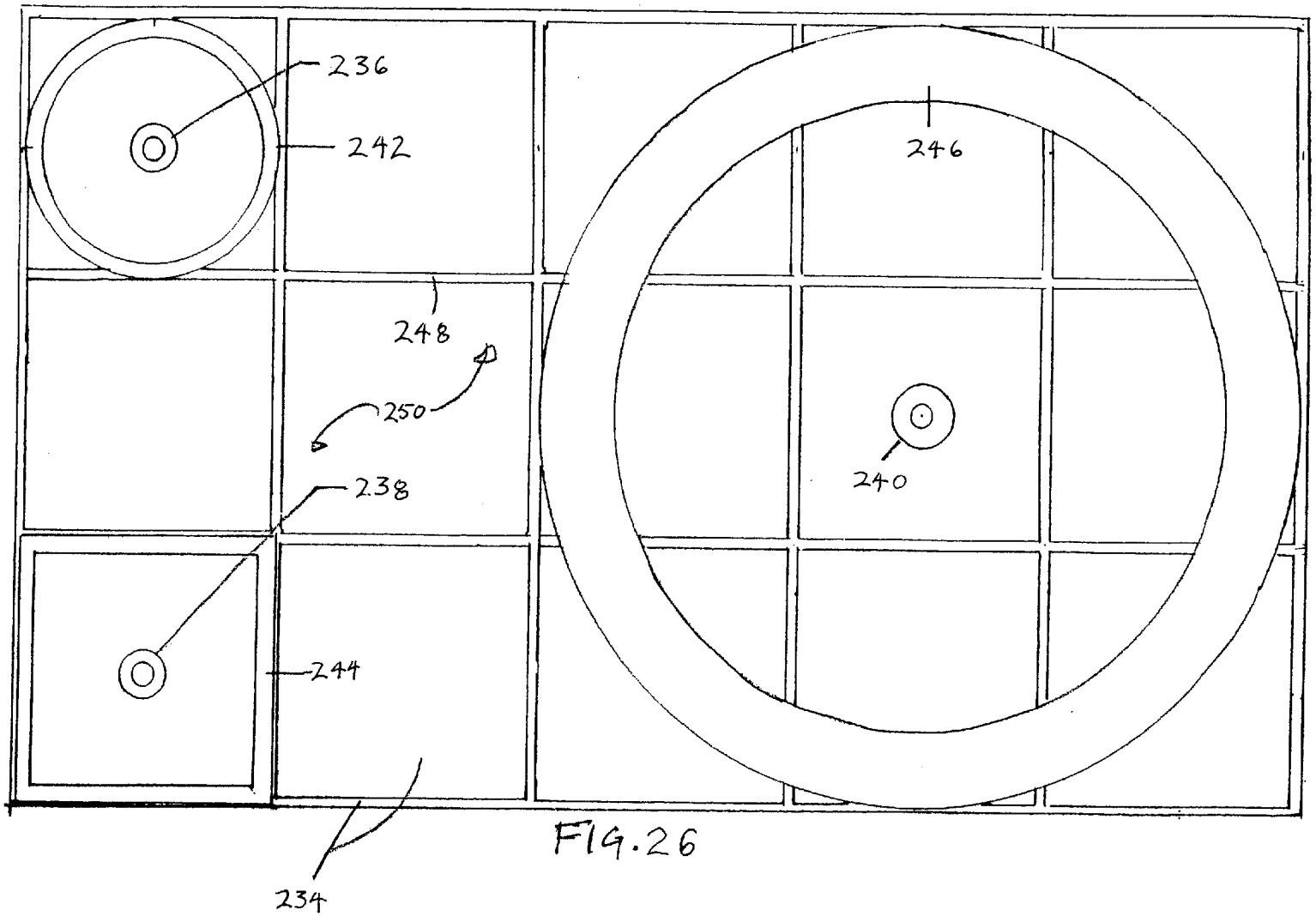
FIG. 26 is a schematic view of a suspended grid ceiling supporting a lighting arrangement.

FIG. 26 illustrates a suspended grid ceiling 234 on which radial beam projectors 236, 238 and 240 have been mounted, either directly or by means of suspension, and are surrounded by refraction rings 242, 244 and 246, respectively—which may be attached to and supported by projectors 236, 238 and 240, respectively or may be attached to the "T" bars 248 or the panels 250 of the suspended grid ceiling 234. The T bar system optically aligns radial beam projector 240 to ring 246. The area of the ceiling to which projector 240 and ring 246 are attached can be recessed above the surrounding ceiling plane. Similarly, projectors 236, 238 and 240 may be mounted directly or suspended from a non-suspended ceiling with the same supporting relationships with rings 242, 244 and 246.

Figures 27, 28, 29, 30:
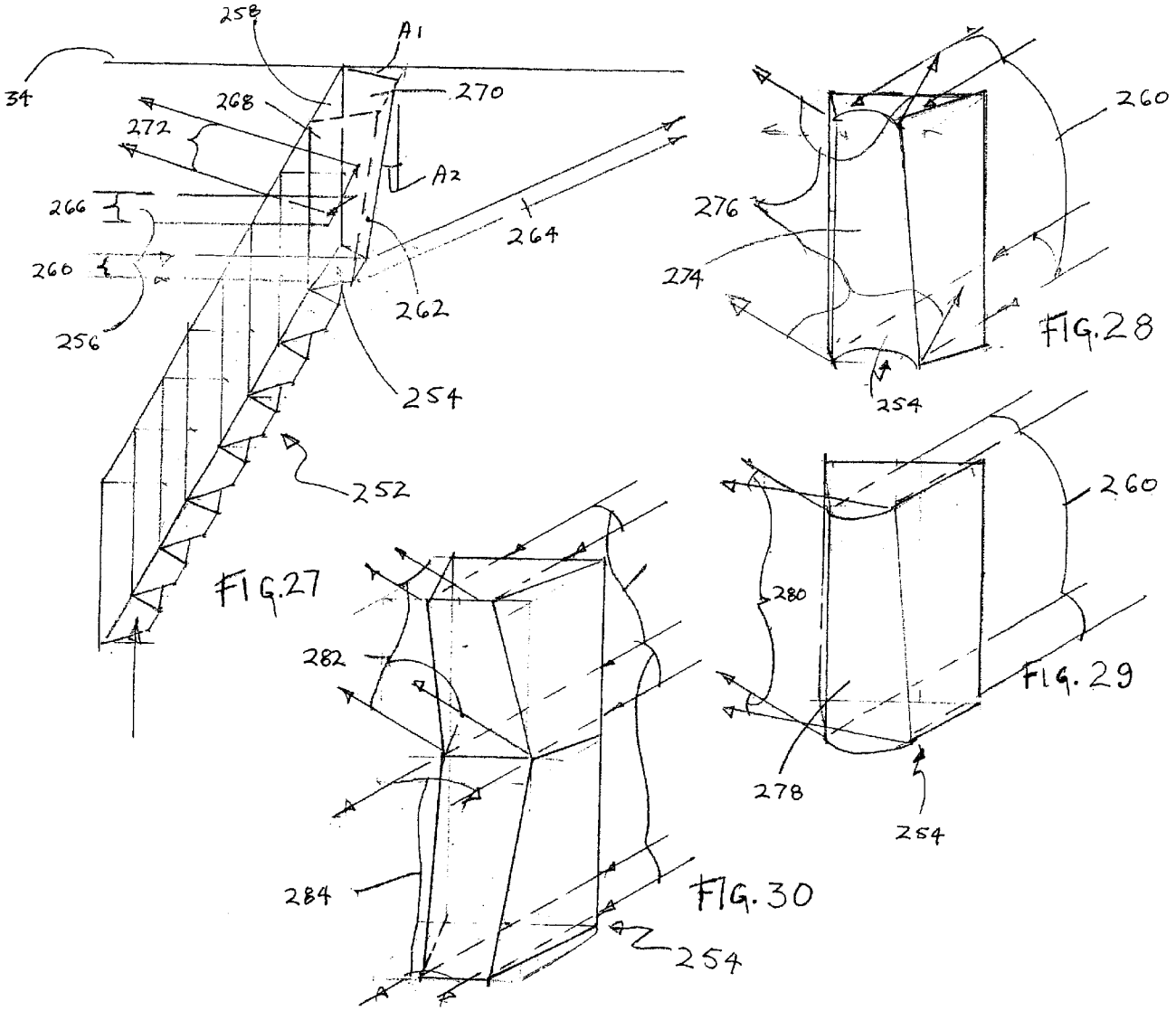
FIG. 27 is an isometric view of an optical body configured in a remote linear arrangement using prisms.
FIG. 28 is an isometric view of a different type of prism.
FIG. 29 is an isometric view of another type of prism.
FIG. 30 is an isometric view of a further type of prism.

FIG. 27 illustrates an optical body 252 (which can be configured in a linear fashion as illustrated or in an oval or circle) comprised as individual prisms 254 which function in the following manner: Entry beam 256 enters entry/exit face 258. A portion of entry beam 256 represented by 260 enters within the vertically centered area of face 258, passes through prisms 254, and is refracted through surface 262 (which is at an acute angle A2 to face 258 forming a wedge prism) as rays 264 toward ceiling plane 34.

The portion of entry beam 256 represented by 266 enters on the vertical edges of 258 and is refracted by total internal reflection from faces 268 and 270 to 270 to 268 (which are angles at 45° [A2] to the entry beams 256) back through 258. Since 268 and 270 are canted off vertical (as illustrated by A2), rays 272 are reflected back to ceiling plane 34.

FIG. 28 illustrates a variation of FIG. 27 in that prism 254 has a negative cylindrical or negative conical exit surface 274 rather than a flat surface. Surface 274 causes rays 260 to diverge as rays 276.

FIG. 29 illustrates another variation of FIG. 27 in that prism 254 has a positive cylindrical surface 278 rather than a flat one. Positive cylindrical surface 278 causes rays 260 to converge, then diverge as rays 280 at the exit of prism 254.

FIG. 30 represents a prism structure 254 that may be constructed as a single unit or as 2 units of prisms 254 of FIGS. 27, 28 and 29. The function of FIG. 30 prism structure 254 is to divide the combined previously described reflective and refractive functions into separate directions, one at an acute direction upwards as rays 282 and one at an acute direction downward as 284.

Figure 31:
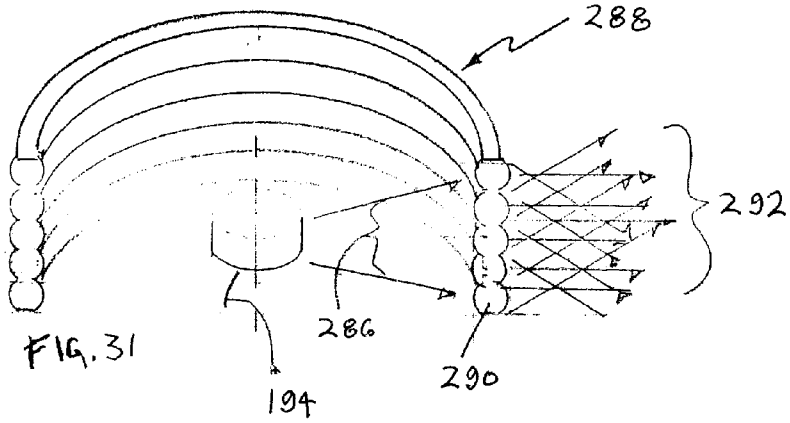
FIG. 31 is an isometric view of a central radial beam projector and a remote refracting ring.

FIG. 31 illustrates a central radial beam projector 194 projecting radial beam 286 to and through remote refracting ring 288. Ring 288 is constructed of horizontally disposed double convex rings (the section being 290) which refract rays 286 as horizontally disposed convergent then divergent bands of radially distributed rays shown as 292.

Figure 32:
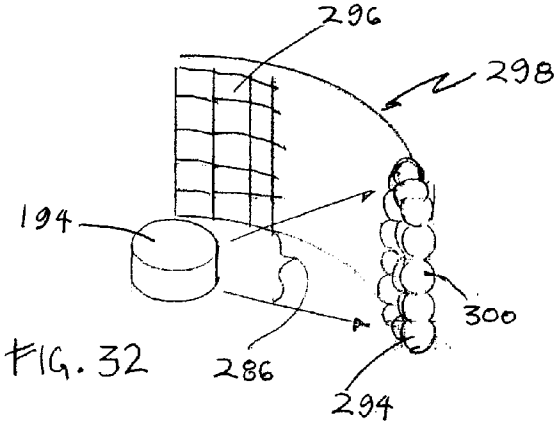
FIG. 32 is an isometric view of a variation of the structure shown in FIG. 31.

FIG. 32 illustrates a variation of FIG. 31 in that the remote refracting ring 298 is comprised of double convex lenses shown in section 294 and as a ring grid shown as 296.

Figure 33:
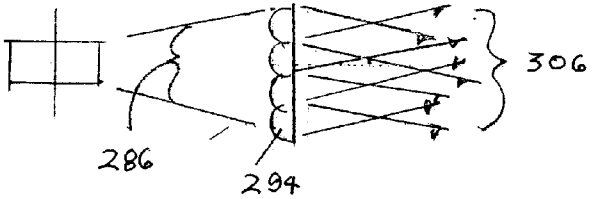
FIG. 33 is a schematic sectional view of the rings shown in FIGS. 31 and 32.

FIG. 33 illustrates a cross section of rings 288 and 298 as plano-convex rings.

Figure 34:
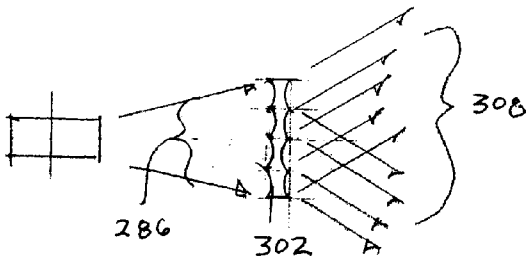
FIG. 34 is a schematic sectional view showing a variation from the rings shown in FIG. 33.

FIG. 34 illustrates a variation of FIG. 33 in that the ring section 302 has a section comprised of double concave areas.

Figure 35:
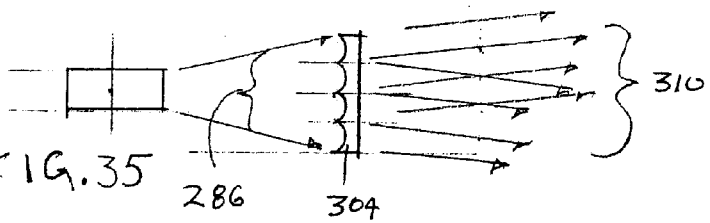
FIG. 35 is a schematic sectional view showing a another variation from the rings shown in FIG. 33.

FIG. 35 is a variation of FIG. 33 in that ring section 304 has a section of plano-concave areas.

The rays of radial projected beam 286 in FIGS. 31, 33, 34 and 35 are refracted through 290, 294, 302 and 304 as 292, 306, 308 and 310, respectively.

Figure 36:
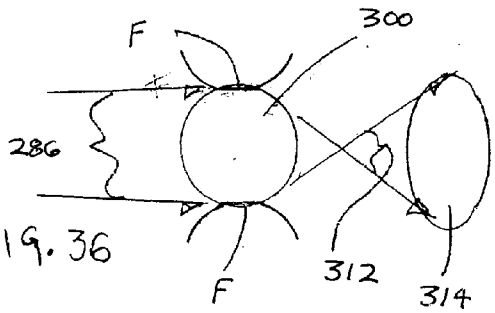
FIG. 36 is a diagrammatic view of a single double-convex lens in a grid or ring of lenses.

FIG. 36 is a single double convex lens 300 shown attached to adjacent lenses at plane F. Entry rays 286 are refracted by 300 resulting in exit rays 312 forming a beam with a defined sectional area 314.

Although not illustrated, the section of the ring lens may be comprised of negative and positive meniscus rings and grids.

Figures 37, 38, 39, 40A, 40B:
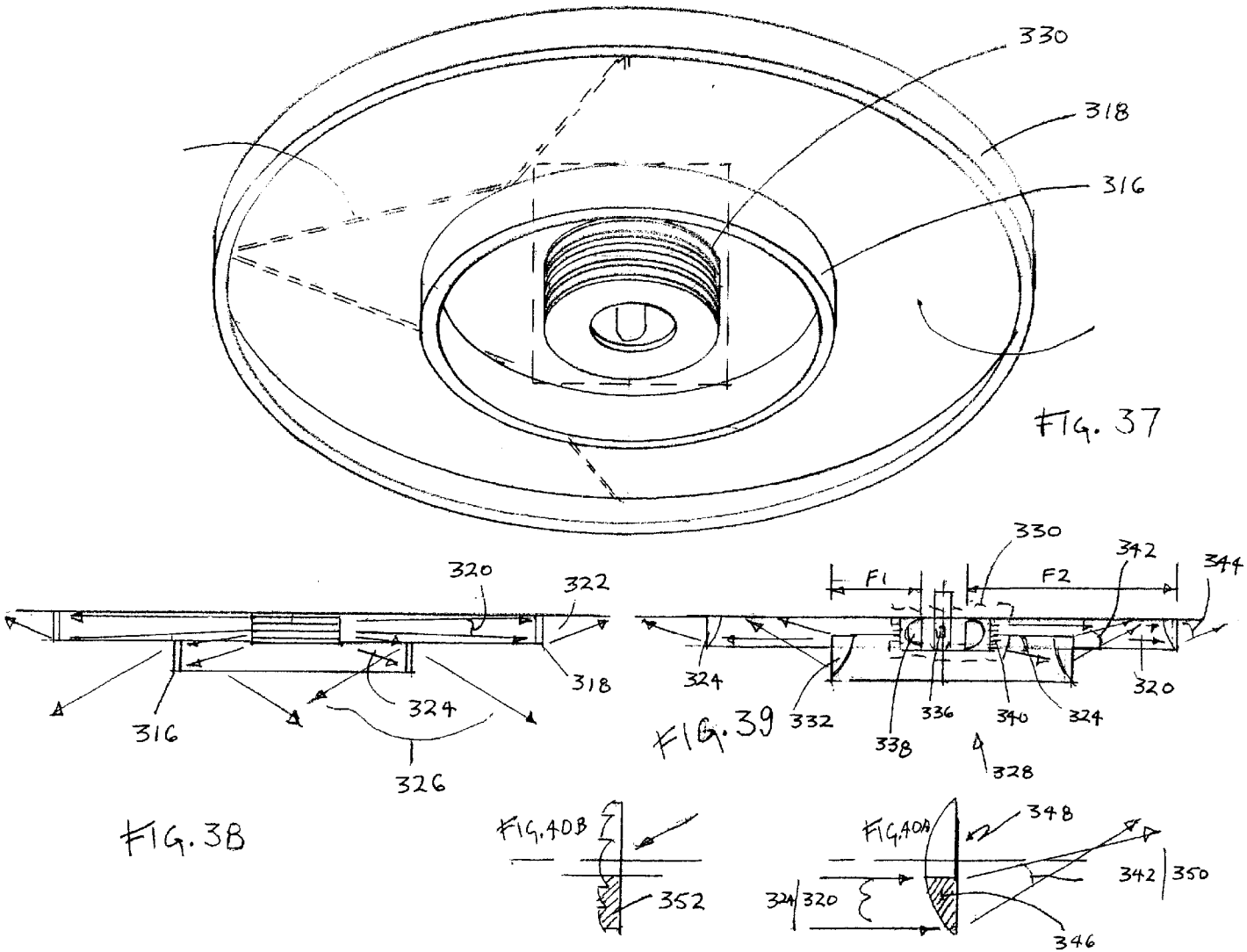
FIG. 37 is an isometric view showing a variation of the structure shown in FIGS. 17, 18 and 19.
FIG. 38 is a schematic sectional view showing each refractive ring having a different function.
FIG. 39 is a schematic sectional view having inner and outer refractive rings.
FIGS. 40A and 40B are schematic sectional views of a segment of a lens.

FIGS. 37, 38 and 39 illustrate a variation of FIGS. 17, 18 and 19 which show a single remote refracting ring 196, 202 and 206 respectively while FIG. 37 shows two remote rings labeled 316 and 318. They may be constructed to have cross-sections and functions of those illustrated in FIGS. 7, 8, 9 and 10, FIG. 12, FIG. 15, FIGS. 27, 28, 29 and 30, and FIGS. 31, 32, 33, 34, 35 and 36.

Although two refracting rings 316 and 318 are shown, a system can be constructed with three or more. One or more of the rings may be square or rectangular. Each refractive ring may have a different function as illustrated in FIG. 38. Outer ring 318 refracts a portion of the radial beam labeled 320 resulting in radial indirect rays 322 while inner ring 316 refracts a lower portion of the radial beam labeled 324 as ambient downlight rays 326.

FIG. 37 shows a supporting system between 318 and 316 which forms a triangular structure 319 formed of wire which does not shadow light emanating from the rings. As an alternative to structure 319, a radial light containment disk 321 (the function of which is described in the text pertaining to FIG. 17) may be used as a structural support for the refractive rings 318 and 316.

FIG. 39 illustrates a cross-sectional view of a radial light distribution structure 328 comprising a radial beam projector 330, an inner refractive ring 332, and an outer refractive ring 324. Both 332 and 334 have a plano-convex profile (or double convex profile, not illustrated) further described in FIGS. 40A and 40B. The radial beam projector 330 is comprised of a lamp 336 surrounded by spherical or aspheric collimating ring 338 and a baffle ring assembly 340 (which is optional to the function of the system). The lower portion of rays 324 of the radial beam projected by the radial beam projector 330 is intercepted and refracted by 332 as rays 342. The upper portion of the radial beam 320 strikes 324 and is refracted as rays 344. If either 332 or 324 is inverted, a corresponding change in the direction of 342 and 344 (respectively) would take place.

FIGS. 40A and 40B illustrate (in section) segment 346 of a piano convex lens 348 and segment 352 of a positive cylindrical lens 348 (respectively). Both 346 and 352 refract rays 324/320 at converging and diverging rays 342/350.

Lens segment such as 346 and 352 may be used in single ring systems such as those shown in FIG. 17, or in systems requiring three or more refractive elements. Lens segment profiles illustrate by 346 and 352 may be incorporated into linear structures as illustrated on FIGS. 7, 8, 9 and 10.

It is ideal for the focal distance of 332 to be equal to F1 (FIG. 39) and the focal distance of 334 to be equal to F2 (FIG. 39).

Figure 41:
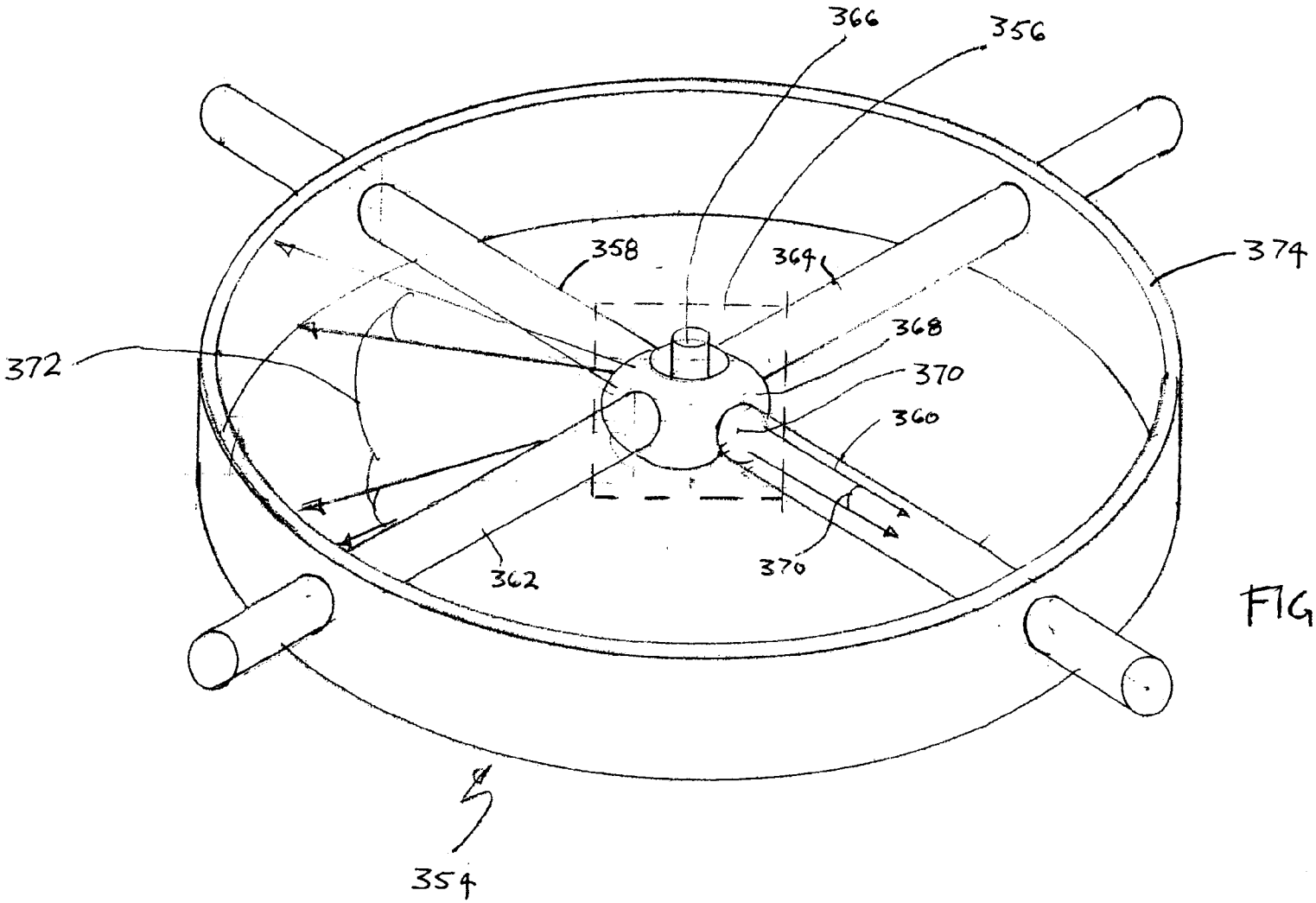
FIG. 41 is an isometric view of a multi-function light distribution structure.

FIG. 41 illustrates a multi-function light distribution structure 354. This structure integrates a multi-function collimator 356 (as described in patent application Ser. No. 08/201.466 filed Feb. 25, 1994 entitled Architectural Lighting Distributed from Contained Radially Distributed Light), linear light distribution elements 358 and 360 (as described in U.S. Pat. No. 5,676,457 Oct. 14, 1997 and patent application Ser. No. PCT/US 98-11382 having an International Filing Date of Jun. 3$^{rd}$, 1998 entitled Refractive and Reflective Wave Lens for Light Shaping). The multi-beam collimator 356 that surrounds lamp 366 is comprised of two optical elements, a ring lens 368 and aspheric lenses 370 located in bores within ring lens 368. The ring lens 368 projects a radially distributed beam 372 which is refracted by radial refracting ring 374 (all profiles and functions of radially refracting ring s previously described in this document may be applied to FIG. 41). The aspheric rings 370 located in the bores of ring lens 368 provide axially collimated light through linear light distribution elements 358, 360, 362 and 364. Although FIG. 41 illustrates four linear light distribution elements, any number may be used with the described system.

The combined lighting arrangement of light distribution elements 358 and 360, ring lens 368 and aspheric lens 370 may be combined with optical structures with any of the ring arrangements shown and described in other figures, such as those of FIGS. 17–20 23–25, 37 and 42.

Figures 42, 43, 44:
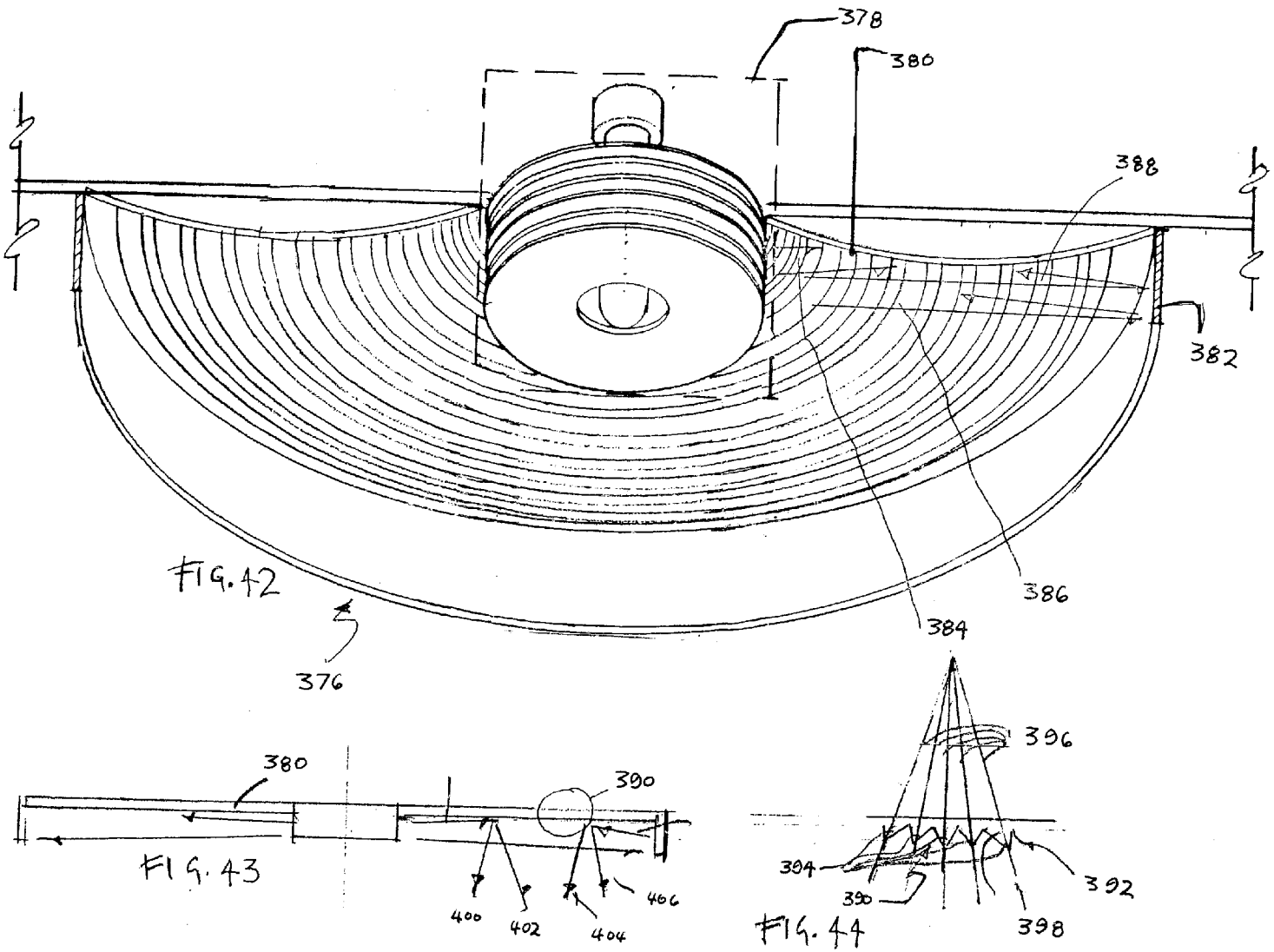
FIG. 42 is an isometric view, partly in section, showing a radial beam projector and a reflecting wave guide.
FIG. 43 is a cross section showing a variation of the structure shown in FIG. 42.
FIG. 44 is a detail view of the showing the grooves of the prisms.

FIG. 42 represents a light distribution structure 376 comprised of a radial beam projector 378, a reflecting wave guide 380 (the structure and function of which is described in Patent Pending Case PCT/US/11382 having an International Filing Date of Jun. 3rd, 1998, entitled Refracting and Reflecting Wave Lens for Light Shaping) and a reflecting ring 382. The radial beam projected from 378 is divided into an upper portion 384 (which strikes and is reflected by 380 directly) and a lower portion 386 which strikes reflecting ring 382. The reflecting surface of reflecting ring 382 is canted so that 386 is reflected towards and onto 380 as 388.

FIG. 43 is a cross-sectional variation of FIG. 42. The variation of 380 is flat in FIG. 43. Detail section 390 of FIG. 42 is further illustrated in FIG. 44.

FIG. 44 shows detail section 390 as concentric circular V grooves 392, formed by parallel isosceles prisms 394, the centerlines 396 of 394 converging at point P. This results in a change of pitch of a typical reflecting face of 398, which in turn changes the direction of rays 400, 401 and 404, 406 (FIG. 43), respectively.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A light assembly comprising:

a. a multiple beam or radial beam projector for directing a focused beam of light radially for being positioned in the vicinity of a ceiling of a room and spaced from at least some of the walls thereof;

b. at least one reflector or refractor element on or adjacent to the walls or ceiling of such room for receiving light from said projector in at least one spaced location and reflecting or refracting light into desired patterns to provide light for such room.

2. A light assembly as defined in claim 1 wherein said projector projects at least two light beams, each toward a separate element.

3. A light assembly as defined in claim 2 wherein the elements are reflectors and at least one of the reflectors reflects light in a linearly divergent pattern.

4. A light assembly as defined in claim 1 wherein the at least one element and the projector are constructed and arranged so that the architectural structure is part of the luminaire alignment.

5. A light assembly comprising:

a. a multiple beam or radial beam projector for directing light radially for being positioned in the vicinity of a ceiling of a room and spaced from at least some of the walls thereof;

b. at least one reflector or refractor element on or adjacent to the walls or ceiling of such room for receiving light from said projector in at least one spaced location and reflecting or refracting light into desired patterns to provide light for such room, said projector projecting at least two light beams, each toward a separate element, and said projector being a multiple beam collimator.

6. A light assembly comprising:

a. a multiple beam or radial beam projector for directing light radially for being positioned in the vicinity of a ceiling of a room and spaced from at least some of the walls thereof;

b. at least one reflector or refractor element on or adjacent to the walls or ceiling of such room for receiving light from said projector in at least one spaced location and reflecting or refracting light into desired patterns to provide light for such room, said projector projecting at least two light beams, each toward a separate element, and said projector being a radial beam projector for projecting radial segments of beams toward the elements.

7. A light assembly as defined in claim 2 wherein said elements are reflectors which are linear and concave, convex or flat in cross-section or divide and reflect projected rays into upwardly reflected rays and downwardly reflected rays or have a pattern of specular convex shapes or are spherically convex.

8. A light assembly as defined in claim 2 wherein said elements are curved or straight refractors which are elongated wedge prisms for receiving the projected beams and refracting them as rays toward the ceiling or elongated segmented wedge prisms for receiving the projected beams and refracting them towards the ceiling or an elongated wedge prism of wedge segments for splitting the projected beams and refracting some of them towards the ceiling and refracting others at an angle away from the ceiling.

9. A light assembly as defined in claim 2 wherein there are at least two reflectors or refractors radially one after the other, the one closer to the projector having window sections to allow the projected light to pass therethrough to the next reflector or refractor.

10. A light assembly as defined in claim 9 herein said reflectors or refractors are mounted for pivotal movement.

11. A light assembly as defined in claim 9 wherein said one closer reflector or refractor is spaced from the ceiling and the next reflector or refractor being closer to the ceiling than said one closer reflector or refractor.

12. A light assembly as defined in claim 9 wherein said one closer reflector or refractor has openings therein which allow light to pass therethrough.

13. A light assembly as defined in claim 2 wherein said elements are refractors which includes alternate wedge prisms which are horizontally and vertically oriented.

14. A light assembly as defined in claim 2 wherein the elements are reflectors which are convex or concave linear reflector or may be segmented into convex and concave portions.

15. A light assembly as defined in claim 2 wherein the elements are reflectors which surround the projector.

16. A light assembly comprising:

a. a multiple beam or radial beam projector for directing light radially for being positioned in the vicinity of a ceiling of a room and spaced from at least some of the walls thereof;

b. a reflector or refractor element surrounding the projector and on or adjacent to the walls or ceiling of such room for receiving radial light from said projector and reflecting or refracting light into desired patterns to provide light for such room.

17. A light assembly as defined in claim 16 wherein there is a circular refractor and a radial containment disk disposed above or below said projector to prevent light from the projector from being directed upwardly or downwardly above or below, respectively, the position of said circular refractor.

18. A light assembly as defined in claim 17 where said refractor refracts light from said projector to provide downwardly directed light.

19. A light assembly as defined in claim 17 said refractor refracts light from said projector to provide upwardly directed light.

20. A light assembly as defined in claim 16 further comprising a radial wave disk refractor below said projector and reflector or refractor.

21. A light assembly as defined in claim 20 wherein said element is a reflector for reflecting light downwardly toward said wave refractor.

22. A light assembly as defined in claim 20 wherein said element is a refractor for refracting a portion of the received light upwardly and a portion of the received light downwardly toward said wave refractor.

23. A light assembly as defined in claim 16 wherein said element is a refraction ring in the form of two flat truncated cones.

24. A light assembly as defined in claim 16 wherein said element is a refractor which includes vertically arranged rings which are double convex or plano-convex or plano-concave or double convex or double concave.

25. A light assembly as defined in claim 16 where there are two elements both being refractors with one surrounding the other and vertically offset from one another so that projected light can reach the outer element.

26. A light assembly as defined in claim 25 further comprising a triangular wire structure for connecting said rings structurally.

27. A light assembly as defined in claim 25 further comprising a focussing ring surrounding said projector.

28. A light assembly as defined in claim 16 wherein said element is a refractor, and further comprising a multi-function collimator which includes a ring lens which provides light to said refractor element and aspheric lenses which provide axially collimated light to linear light distribution assemblies.

29. A light assembly as defined in claim 16 wherein said element is a reflecting ring, and further comprising a wave reflector disposed between said reflecting ring and said projector, said wave reflector and said reflecting ring being constructed and arranged so that the light which reflects from said ring is projected onto said wave reflector and a portion of the projected light is directed onto said wave reflector.

30. A light assembly as defined in claim 29 wherein said wave guide is flat and has concentric circular V grooves.

31. A light assembly as defined in claim 29 wherein said wave reflector is curved in section.

32. A light assembly as defined in claim 25 further comprising a radial light containment disc supporting the rings.

33. In a light assembly of the type having a central projector for directing light radially and a remote reflector or refractor element, the improvement comprising:

a plurality of sequential prisms forming the element and constructed and arranged so that an entry beam is split into two parts, one part being directed upwardly in the same direction the entry beam was going, and the other part being directed upwardly in the opposite direction the entry beam was going thereby performing both a refracting and a reflecting function.

34. A light assembly as defined in claim 5 wherein at least one of the light beams is a defined shape, at least one reflector is an architectural surface and the area of the surface on which the beam impinges is of a defined shape of significantly greater brightness than the surrounding area of said surface.

* * * * *